United States Patent [19]

Upton et al.

[11] Patent Number: 4,977,754

[45] Date of Patent: Dec. 18, 1990

[54] NEXT-TO-BE-PURCHASED COLD BEVERAGE MERCHANDISER

[75] Inventors: Ronald D. Upton; Michael A. Branz; Edmund S. Richardson, all of Spartanburg, S.C.

[73] Assignee: Specialty Equipment Companies, Inc., Berkeley, Ill.

[21] Appl. No.: 517,345

[22] Filed: May 1, 1990

[51] Int. Cl.[5] ..... A47F 3/04

[52] U.S. Cl. ..... 62/248; 62/255; 62/277; 62/440; 221/150 R; 312/116

[58] Field of Search ..... 62/246, 248, 251, 277, 62/378, 382, 440, 255, 256; 221/150 R; 312/116

[56] References Cited

U.S. PATENT DOCUMENTS

| | | | |
|---|---|---|---|
| 2,438,972 | 4/1948 | Hoffman . | |
| 2,538,780 | 1/1951 | Hazard | 62/378 |
| 2,542,136 | 2/1951 | Hanson et al. . | |
| 2,641,112 | 6/1953 | Muffly | 62/378 |
| 2,673,455 | 3/1954 | Brinkoeter . | |
| 2,706,387 | 4/1955 | Swanson . | |
| 3,025,681 | 3/1962 | Booth | 62/248 |
| 3,307,373 | 3/1967 | Booth | 62/248 |
| 3,462,966 | 8/1969 | Reid et al. | 62/248 |
| 3,759,059 | 9/1973 | Kenyon | 62/246 |
| 3,898,864 | 8/1975 | Steelman | 62/256 X |
| 4,009,586 | 3/1977 | Skvarenina | 62/80 |
| 4,478,047 | 10/1984 | Ibrahim | 62/256 X |
| 4,676,074 | 6/1987 | Morgan, Jr. et al. | 62/378 X |
| 4,741,172 | 5/1988 | Aoki . | |
| 4,750,335 | 6/1988 | Wallace et al. | 62/248 |

OTHER PUBLICATIONS

Beverage Air Brochure for Model MT52-C (1977).

Beverage Air Slide Door Marketeers Brochure for Models MT 33, 38, 45, 66 (1986).

Beverage Air Floral Cabinet Model FC45GE Brochure (5/1990).

Beverage Air Gravity Feed Can Rack Brochure (403-170A) (1983).

Beverage Air Cold-Flo Gravity Shelf Organizer Brochure (5/1990).

Beverage Air Cold-Flo Phase II One Piece Gravity Organizer Brochure (5/1990).

Truetrac II One Piece Self-Serve Organizers Brochure (5/1990).

Mead Merchandisers Gravity Flow Organizers Photo (5/1990).

*Primary Examiner*—Lloyd L. King

*Attorney, Agent, or Firm*—Dority & Manning

[57] ABSTRACT

A beverage merchandiser for refrigerating and displaying single-serving containers disposed on gravity feed shelves has a refrigerated compartment accessed by sliding, multi-pane glass panel doors mounted on rollers engaging side-by-side overhead tracks. An evaporator is disposed inside the refrigerated compartment near the top and rear walls of same and is configured with a shallow height relative to the depth of the evaporator to save space. A duct panel forms a duct along the top wall of the refrigerated compartment to direct cooled air from the evaporator toward the product nearest the doors of the merchandiser to keep this product cool, since it is the next-to-be-purchased product. The glass panes of the doors are kept defogged by a defogging mechanism. One of the defogging mechanisms uses air warmed in a housing for the condenser and compressor and provides same to a slot oriented in a grill, which is disposed beneath the bottom edge of the doors. The warmed air is removed from the housing through a blower connected to the slot via a flexible conduit. In an alternative embodiment of the defogging mechanism, a slot is provided in an exit chute disposed above the top of the door panels. An enclosure is provided behind an illuminated sign in which is disposed a light fixture and a blower. The heat generated by the light used in the fixture is forced through the chute by the blower and directed into the glass panels from above the door panels.

20 Claims, 4 Drawing Sheets

NEXT-TO-BE-PURCHASED COLD BEVERAGE MERCHANDISER

BACKGROUND OF THE INVENTION

The present invention relates to cold beverage merchandisers and more particularly to a forced cold air circulation, continuously defogged, cold beverage merchandiser.

Increasing labor costs, among other factors, have prompted beverage retailers to use refrigerated storage equipment that permits the customers to serve themselves rather than requiring store personnel to remove the beverages from the storage equipment. Such equipment for storing canned or bottled beverages has become a tool for marketing or merchandising same. Thus, equipment for storing beverages emphasizes advertising and display of the containers to the customer Soft drinks, beer, wine coolers, etc. have been marketed for sale in six-packs containing six individual single serving containers, having 12 or 16 fluid ounces for example. The consumer would select a six-pack and bring it home for storage in the refrigerator prior to consumption. Refrigerated cabinets for merchandising six-packs typically have horizontal shelves and an evaporator disposed in the upper rear portion of the cabinet. The flow of cold air typically is directed by a fan downwardly from the evaporator along the rear wall of the cabinet to the bottom of the cabinet, frontwardly along the bottom of the cabinet to the front glass panels of the cabinet, then upwardly along the front glass panels of the cabinet to the top of the cabinet, and rearwardly along the top of the cabinet to the evaporator. A rectangular box housed an elongated fluorescent bulb used to light an advertising display at the front top of some of these 6-pack cabinets. In these 6-pack cabinets with lighted advertising displays, the width of the evaporator extended approximately the width of the cabinet, and the height of the evaporator extended in a direction parallel to the height of the cabinet. In these lighted advertising display cabinets, the depth of the evaporator was the smallest dimension of these evaporators and extended in a direction parallel to the depth of the cabinet. However, in cabinets lacking such lighted displays, the height of the evaporator was the smallest dimension and extended in a direction parallel to the height (measured from top to bottom) of the cabinet.

One problem that occurs with self-service beverage merchandisers is the tendency of the transparent viewing surface to fog with condensation forming thereon. The problem of fogging viewing surfaces has been counteracted in a number of ways, including the establishment of a flow of warm air over the glass panels forming the viewing surface. The relative effectiveness of designs for establishing this flow of warm air depends upon various factors such as whether the transparent surface is stationary or forms part of a door or cover giving access to the interior of the refrigerated space. Other factors involve whether the viewing surface has a single pane or is a multi-pane window. Still other factors pertain to the shape of the transparent surface, the location of the transparent surface relative to other surfaces, and the manner in which the transparent surface may be moved or manipulated by the customer.

U.S. Pat. No. 3,462,966 to Reid et al (assigned to a subsidiary of the assignee of the present application) discloses a way of removing condensation forming on the inner surface of a glass panel of a refrigerator door when the door is opened. This refrigerated cabinet has a pair of door panels. Each door has a tubular frame 32 around the perimeter of a glass panel 34. The door panels are hingedly mounted on the front edge portion 14 of the cabinet. A condenser coil assembly 54 is mounted within a non-refrigerated space below the refrigerated space and insulated therefrom. A condenser fan 56 is also mounted within the non-refrigerated space rearwardly of the condenser coil. Centrally mounted within the non-refrigerated space at the forward end is an air scoop device 78 provided with a dimensionally enlarged inlet end aligned with the condenser coil assembly 54 and close thereto to converge forwardly from the inlet to an outlet end positioned just below the forward edge portion of the wall 28 which partitions the refrigerated space from the non-refrigerated space. The air flow is induced to pass between the coils of the condenser coil assembly for heat exchange purposes that results in the discharge of heated air through a front grill 16 which extends horizontally across the lower front portion of the cabinet and is removably mounted thereon. A deflecting portion 96 of the grill work behind front grill 16 cooperates with scoop device 78 and duct forming members 98 to laterally distribute the air flowing upwardly from an opening in the grill. Thus, the front grill discharges warm air vertically in an upward direction to form a warm air curtain in front of the access opening closed by the door panels. The access opening to the refrigerated space is formed in a plane with which the front edge portions of the cabinet walls are aligned. Magnetic strips within peripheral sealing elements or strips are mounted on the tubular frame of each door panel for contact with the forward edge portions of the side walls, the partition wall 28 separating the refrigerated cabinet from the non-refrigerated cabinet, and the top wall. The magnetic strips cooperate with the magnetic inserts to hold the door panels closed. The door panels are disposed externally of the cabinet rather than being recessed in the edge portions of the cabinet walls as in prior constructions. This prevents the door panels from being directly exposed to the cold zone of the refrigerated space. The door panels also extend downwardly beyond the refrigerated space and overlap the front edge portion of the wall 28 which separates the refrigerated space from the non-refrigerated space. Thus, the air rising from the front grill immediately contacts the tubular frames of the door panel assemblies. When the door panel assemblies are opened, the upward air flow forms an air curtain or barrier between the atmosphere and the refrigerated space, this air curtain being more effective in defogging the door panels because of the panel mounting externally of the cabinet.

In order to assure adequate defogging, warm air must be provided to the transparent panel on a continuous basis. Thus, the compressor fan is operated continuously, rather than only when the compressor is operating in its refrigeration cycle. This reduces the efficiency of the refrigeration equipment. Moreover, the location of the condenser and compressor fan near the floor results in the transfer of dust and dirt into the condenser when the compressor fan operates. Continuous operation of the compressor fan provides a continuous flow of dust and dirt into the condenser. Periodic removal of such extraneous matter from the condenser is required to maintain the efficiency of the condenser and compressor operation at acceptable levels.

As shown in FIG. 5 of Reid et al, diagonally disposed side struts (unnumbered) are used to bear the load of the cabinet and transfer it to the base panel, which is supported by the cabinet legs that bear the entire weight of the cabinet. The attachment of the triangular struts to the base panel results in structural stresses that are borne by the 0.075 inch thickness (14 gauge) of the base panel. In washing machine cabinets for example, load bearing diagonally disposed struts mount upon and transfer the weight of the machine directly to the central shaft of the legs of the washing machine cabinet.

With the advent of the "fast food" society, the merchandising of canned and bottled beverages has shifted from six-packs to individual containers, which are immediately consumed by the purchaser. This has imposed additional performance requirements upon the refrigerated merchandising equipment that stores and displays these individual containers. Such equipment must effect the quickest possible cooling of the containers that are "next-to-be-purchased." These are the cans, cartons, and bottles disposed at the very front of the shelves, nearest the access opening of the cabinet. Moreover, the increased cooling requirement for this next-to-be-purchased product may result in increased temperature differentials between the interior of the refrigerated cabinet and the exterior atmosphere at the location of the glass viewing panels in the cabinet doors. Such greater temperature differentials render the defogging of these door windows more difficult to accomplish.

OBJECTS AND SUMMARY OF THE INVENTION

It is a principal object of the present invention to provide a refrigerated beverage merchandiser that provides quick and even cooling of the next-to-be-purchased container of beverage, while efficiently maintaining defogged viewing surfaces and maximizing usage of the refrigerated storage space.

Another principal object of the present invention is to provide a refrigerated beverage merchandiser that permits relatively easy and uncomplicated servicing of the refrigeration equipment.

A still further principal object of the present invention is to provide a refrigerated beverage merchandiser that is efficiently constructed to minimize the gauge of the panels while not sacrificing load bearing capability.

Yet another principal object of the present invention is to provide a beverage merchandiser that maximizes the storage capacity of the space in the refrigerated compartment.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the refrigerated merchandiser of the present invention preferably includes a refrigerated compartment for holding items to be cooled. The compartment preferably is surrounded by heat insulation and defines a rear wall, a top wall, a pair of end walls, a front wall, and a bottom wall.

In accordance with the present invention, means are provided for allowing the patron to have selective access to the refrigerated compartment. The selective access means preferably includes a compartment access opening and at least one door having at least one transparent glass panel. Each compartment access opening permits patrons to gain access to the interior of the compartment for the purpose of removing refrigerated items stored in the compartment. Each compartment access opening preferably is defined at least in part near a free edge of the front wall of the compartment. Preferably, each door has a triple pane glass panel. The doors of the selective access means can be sliding doors. In sliding glass door embodiments, the selective access means further includes at least two rotatable rollers attached to the top edge of each door, and at least two overhead tracks arranged side-by-side. Each track receives the rollers attached to each door and extends along the length of the access openings Each track preferably is disposed above the compartment access opening.

In further accordance with the present invention, a housing is provided which is heat insulated from the refrigerated compartment. The housing preferably defines a top panel connected to two opposed side panels and combining to define a front opening.

In further accordance with the present invention, a cabinet is provided for enclosing the compartment and the housing therewithin. The cabinet preferably includes a base.

In yet further accordance with the present invention, a condenser is mounted for selective disposition into and out of the housing. Preferably, the condenser is disposed near the front opening of the housing.

In still further accordance with the present invention, a compressor is mounted for selective disposition into and out of the housing. The compressor preferably is mounted farther from the front opening of the housing than the condenser.

In further accordance with the present invention, a condenser fan is provided for operating in conjunction with the operating cycle of the compressor. The condenser fan preferably is disposed between the compressor and the condenser. A condensate tray also can be disposed between the compressor and condenser fan.

In still further accordance with the present invention, means are provided for transferring warmed air onto the selective access means to continuously defog the selective access means. The defogging means preferably includes an elongated channel disposed below the selective access means along the front of the merchandiser and communicating with the housing to receive warmed air from the housing. The channel preferably has an exit slot defined by a front edge member having a free edge disposed parallel to the selective access means. The defogging means also preferably includes an auxiliary blower disposed in the housing to one side of the condenser and the compressor and having an inlet disposed to face toward the air space between the condenser and the compressor. The defogging means further preferably includes a conduit having one end communicating with the outlet of the auxiliary blower and an opposite communicating with the channel. The conduit preferably includes a flexible portion. The channel preferably is disposed in an elongated front grill that is disposed in front of the front opening of the housing. When the doors are closed to block access through the opening of the compartment, the channel preferably extends substantially the full length of the extent of the glass panels of the doors.

In an alternative embodiment of the defogging means, an enclosure is provided for housing a lighting display. This enclosure preferably is defined between the compartment and the cabinet and is disposed above the selective access means. This embodiment of the defogging means also includes a lamp fixture disposed in the enclosure for receiving a lamp which generates heat when in use. This embodiment of the defogging means also includes an elongated exit chute disposed in the enclosure at a location close to the selective access means. This embodiment of the defogging means further includes an auxiliary fan disposed so as to move air heated by a lamp in the light fixture through the exit chute of the enclosure when the fan is activated. The auxiliary fan preferably is disposed to generate a current of air moving in a direction going from one compartment end wall to the opposite compartment end wall. This embodiment of the defogging means also preferably includes a front exit lip member extending substantially the full length of the extent of the selective access means along the front of the merchandiser. This front exit lip member preferably is configured and disposed to direct air exiting the chute so as to attach the air flow to the exterior surface of the selective access means.

In yet further accordance with the present invention, an evaporator is provided and disposed inside the refrigerated compartment near the top wall of the compartment and closer to the rear wall than to the front wall. The evaporator produces cooled air in its vicinity. The evaporator preferably is shaped as a right angle parallelepiped having a width extending between the two end walls of the refrigerated compartment, a height disposed to extend in a direction normal to the top wall of the compartment and parallel to the rear wall of the compartment, and a depth disposed to extend in a direction normal to the rear wall of the compartment and parallel to the top wall of the compartment. Moreover, the height of the evaporator is the smallest dimension, and the width is the largest dimension.

In still further accordance with the present invention, means are provided for circulating the cooled air leaving the evaporator so that the path of cool air circulation begins by moving toward the selective access means before the cooled air moves toward any other portion of the compartment. In this way, the cooled air can be directed toward the product stored closest to the selective access means near the front opening of the compartment. This facilitates priority cooling of the next-to-be-purchased product located closest to the selective access means.

The cooled air circulation means preferably includes a duct panel and a cold air blower. The duct panel preferably is disposed near the top of the compartment and defines a duct having an opened rear end facing away from the selective access means and toward the rear wall of the compartment. The evaporator preferably is disposed at the rear end of this duct. The duct panel also has a forward free edge that defines a duct exit and is configured to direct air exiting from the duct toward the selective access means. The cold air blower preferably is disposed relative to the duct for moving air cooled by the evaporator through the duct exit. The forward free edge that defines the duct exit preferably is disposed at the free end of a forward exit flap of the duct panel that is configured to direct air exiting from the duct toward the doors that provide selective patron access to the refrigerated compartment opening. Moreover, the front compartment wall preferably extends from the top compartment wall and is configured to direct air flow toward the duct exit.

In still further accordance with the present invention, means are provided for pivotally supporting the rear end of the duct panel. The pivotal supporting means preferably includes a cylindrical mounting post that extends from each compartment end wall. The pivotally supporting means further includes a hooked rear end disposed at the rear end of the duct panel for engaging the cylindrical mounting post.

In still further accordance with the present invention, means are provided for detachably supporting the duct panel at a predetermined orientation relative to the selective compartment access means. The detachably supporting means preferably includes a twist lock or a knurled head fastener The detachably supporting means also includes a keyed flange extending from each of the end walls for engaging the twist lock or knurled head fastener. A fixture for a fluorescent lamp can be mounted to the underside of the duct panel in the vicinity of the forward exit flap to cast light on the product stored in the refrigerated compartment.

In further accordance with the present invention, at least four legs are provided for supporting the cabinet above the floor on which the merchandiser rests. Each leg has a central shaft extending vertically through the base of the housing. In addition, at least four load bearing braces are provided. Each brace has one end extending from beneath the top panel of the housing and an opposite end mounting at one of the central shafts of the legs. Furthermore, at least one hanger is provided for carrying the housing. Preferably, four hangers are provided, and each hanger has one end carried by the end of each of the load bearing braces that extend from beneath the top panel of the housing.

In yet further accordance with the present invention, shelving is provided for supporting beverage containers. Each shelf preferably extends from just in front of the rear wall of the compartment to just behind the access opening of the compartment. Moreover, the shelves are mounted on front standards and rear standards. The standards are mounted to the compartment end walls with a key-hole and stud attachment mechanism. Moreover, preferably the rear standards are mounted higher above the compartment bottom wall than the front standards so that the end of each shelf nearest the rear compartment wall is disposed at a greater height from the bottom compartment wall than the end of the shelf nearest the compartment access opening. In this way, the beverage containers are disposed under the influence of gravity to move toward the front of the shelf as each next-to-be-purchased container is removed from the shelf and creates a space near the front of the shelf.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

Figure 1:
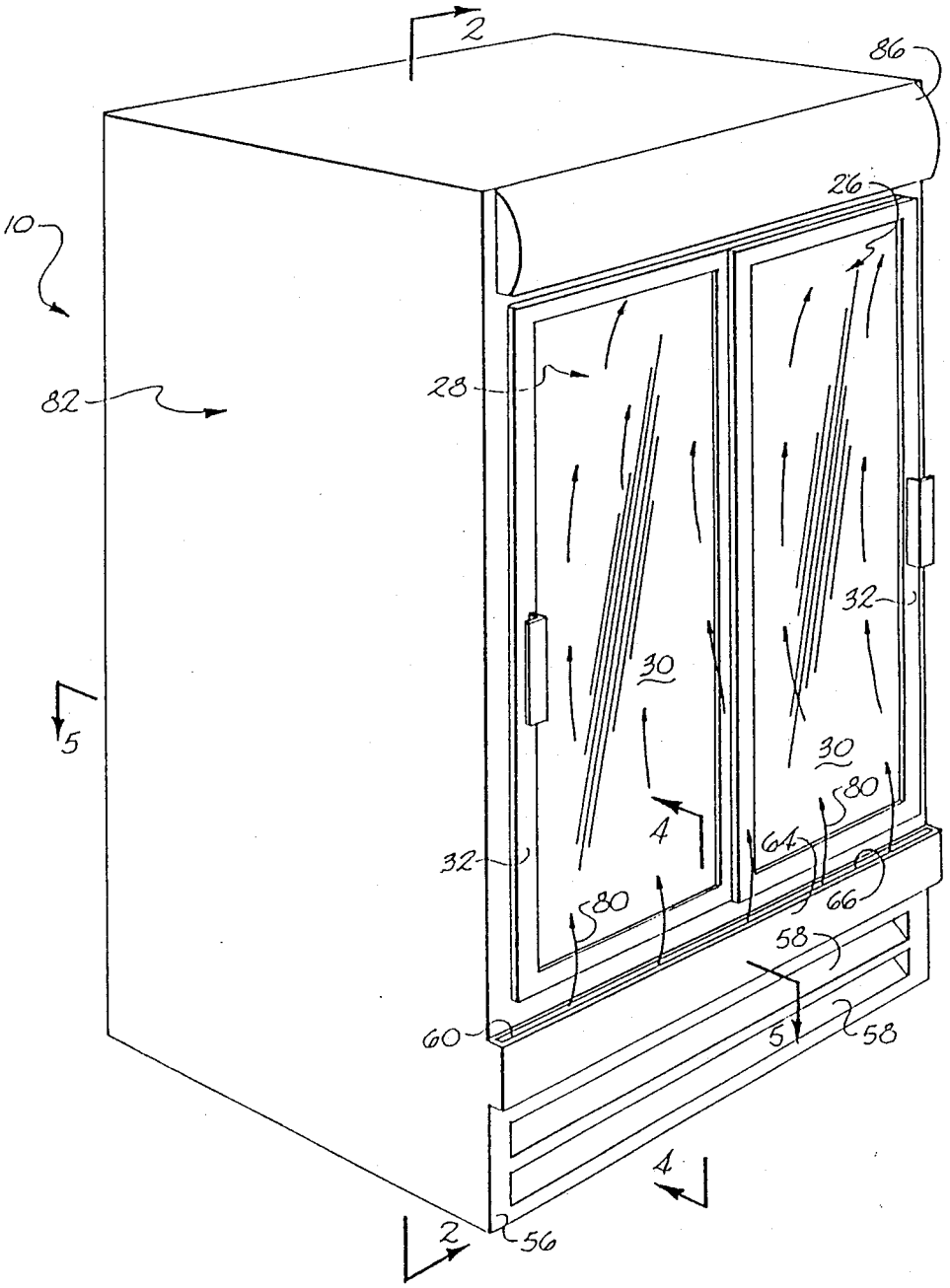
FIG. 1 illustrates an elevated perspective view from the front and side of a preferred embodiment of the refrigerated beverage cabinet constructed in accordance with the present invention.
Figure 4:
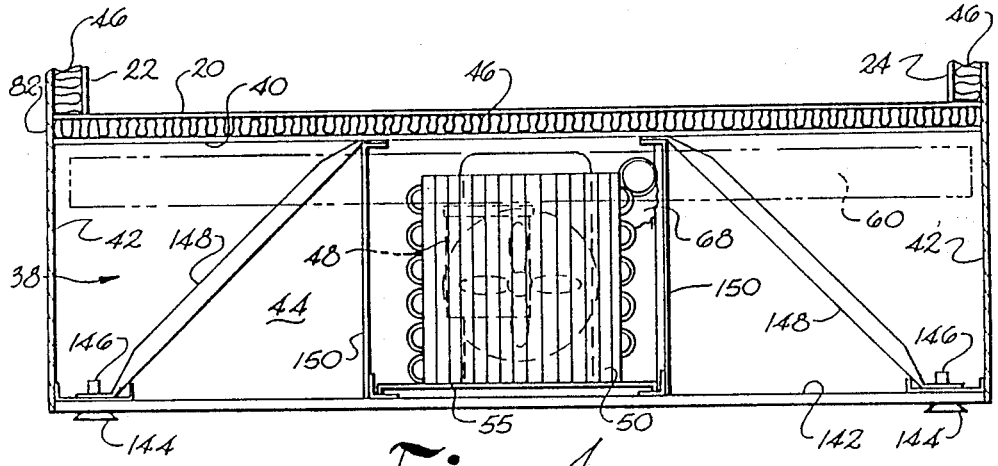
FIG. 4 illustrates a partial cut-away plan view taken along the line of sight indicated by the direction in which arrows 4—4 point in FIG. 1.

A preferred embodiment of the next-to-be-purchased cold beverage merchandiser of the present invention is shown in FIG. 1 and is represented generally by the numeral 10. In accordance with the present invention, a refrigerated compartment is provided for holding items to be cooled. The refrigerated compartment preferably is defined by a rear wall, a top wall, a pair of end walls, a front wall, and a bottom wall. As embodied herein and shown in FIG. 2 for example, a compartment is indicated generally by the numeral 12 and is defined by a rear wall 14, a top wall 16, a front wall 18, and a bottom wall 20. As shown in FIG. 4 for example, compartment 12 is further defined by opposing end walls 22, 24. Heat insulation 46 (shown by looping line) is provided around the outside of the walls forming compartment 12.

Figure 2:
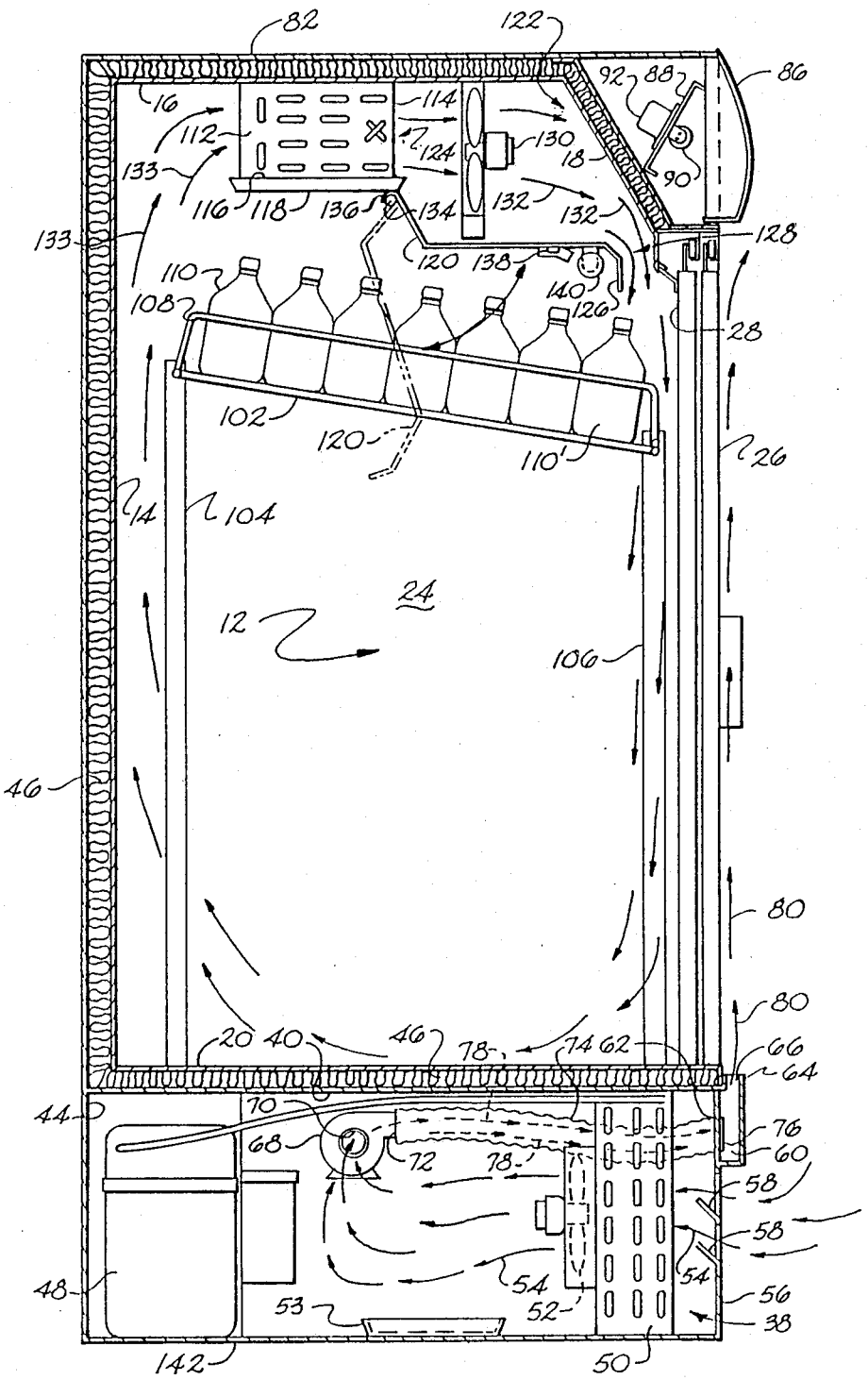
FIG. 2 illustrates a cut-away side plan view taken along the line of sight 2—2 in the direction of the arrows in FIG. 1.
Figure 3:
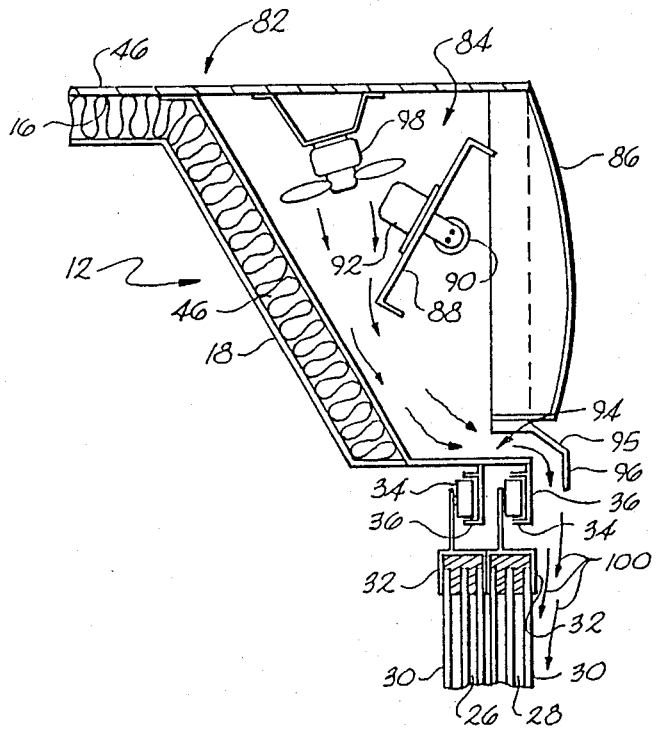
FIG. 3 is side plan cut-away view of an alternative preferred embodiment of components of the present invention.

In further accordance with the present invention, means are provided for allowing selective customer access to the refrigerated compartment. The selective access means includes at least one compartment access opening defined between the bottom wall and the front wall of the compartment. As shown in FIGS. 2 and 3 for example, each compartment access opening preferably is defined at least in part near a free edge of front wall 18. The selective access means further preferably includes at least one door. The doors can be hinged to open outwardly from the merchandiser or can be mounted to slide from side-to-side across the compartment access opening. When the door is opened, it provides access to the compartment opening. When the door is closed, it denies access to the compartment opening. Thus, the door selectively limits access to the compartment access opening by selectively providing and denying access to the compartment access opening.

As embodied herein and shown in FIGS. 1 and 3 for example, a side-by-side pair of sliding doors are indicated generally by the designating numerals 26 and 28. Each door 26, 28 preferably includes a triple pane, glass panel 30 as shown in FIG. 3 for example. Each glass pane of panel 30 is separated from the adjacent pane by an air space. Preferably, the front and back panes are formed of tempered safety glass, while the middle pane disposed between the front pane and the back pane can be formed of untempered glass. Each panel 30 is preferably surrounded by a frame 32 formed of a thermal barrier material such as a plastic extrusion or a combination of metal and plastic or the like. The number of doors 26, 28 depends upon the size of the merchandiser, and more or less than two doors can be used.

As shown in FIG. 3 for example, in sliding door embodiments, the selective access means further preferably includes at least one overhead track 36 disposed across and above the compartment opening of the selective access means. In the preferred double side-by-side sliding door embodiment shown in FIGS. 1–3 for example, two overhead tracks 36 are disposed side-by-side, and each door has at least two rotatable rollers 34 attached to the top edge of the door. Each overhead track 36 slidably receives rotatable rollers 34 of one door 26, 28 to enable each door to slide in its own track disposed one in front of the other and from one side to the other.

In still further accordance with the present invention, a housing is provided. The housing is heat insulated from the refrigerated compartment and defines a top panel, two opposed side panels, and a front opening. As embodied herein and shown in FIGS. 2, 4 and 5 for example, a housing is indicated generally by the numeral 38. Housing 38 defines a top panel 40 two opposed side panels 42, a rear panel 44, and a front opening disposed opposite rear panel 44. Preferably, an opening takes the place of rear panel 44. Moreover, in embodiments with a rear panel, the rear panel is slotted (not shown) to permit air to flow through the slots. In addition, as shown in FIG. 2 for example, heat insulation 46 is disposed between compartment bottom wall 20 and housing top panel 40.

Figure 5:
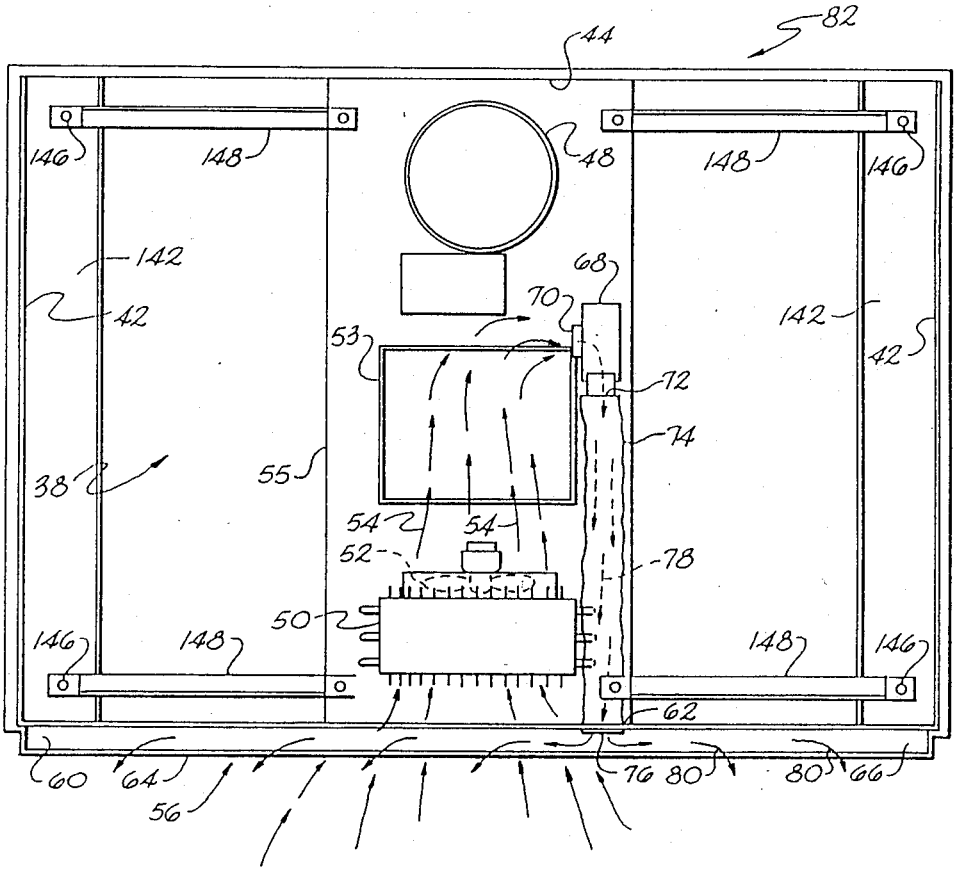
FIG. 5 illustrates a partially cut-away plan view taken along the line of sight indicated by the direction in which arrows 5—5 point in FIG. 1.

In yet further accordance with the present invention, a compressor and condenser are mounted within the housing along with a condenser fan that operates in conjunction with the operating cycle of the compressor. The condenser fan preferably is disposed between the compressor and the condenser, which preferably is disposed toward the housing front opening at the front of the merchandiser. The condenser fan preferably only operates to draw air through the condenser from outside the merchandiser during operation of the compressor. As embodied herein and shown in FIGS. 2, 4 and 5 for example, a compressor 48 is mounted within housing 38 near rear panel 44. A condenser 50 is mounted in housing 38 and disposed closer to the front opening of housing 38 than is compressor 48. Since they are mounted within housing 38, which is heat insulated from compartment 12, compressor 48 and condenser 50 are mounted outside of compartment 12. As shown in FIG. 2 for example, a condenser fan 52 preferably is mounted between compressor 48 and condenser 50 and directly behind condenser 50. Condenser fan 52 (shown in phantom in FIG. 4 for example) includes a rotatable blade mounted on a shaft driven by an electric motor. Condenser fan 52 is preferably operated only in conjunction with operation of compressor 48. When operated, condenser fan 52 draws air into condenser 50 from outside the merchandiser as shown by arrows 54 in FIG. 5 for example. Condenser fan 52 draws this air through condenser 50 and tends to discharge this air towards rear panel 44, which preferably is slotted (not shown in the Figures) to exhaust this air through the housing's rear opening or the slots of panel 44. The exhaustion of this air is not shown in FIGS. 2 and 5, which have been drawn to illustrate another important feature of the invention. The air drawn into housing 38 from outside the merchandiser is warmed upon passing near and through condenser 50, which gives off heat as the refrigerant is condensed within the tubes of condenser 50. As shown in FIGS. 2 and 5 for example, a condensate tray 53 can be provided to receive condensate from the sweating of the evaporator (described hereafter). Typically, the condensate tray would be disposed behind condenser fan 52 in order to be exposed to the heated air drawn through condenser 50 by condenser fan 52.

Preferably, a mounting base 55 (see FIG. 4 for example) is disposed beneath compressor 48, condenser 50, condenser fan 52, and condensate tray 53. This mounting base would be itself slidably mounted for selective disposition into and out of housing 38 in order to facilitate servicing of the refrigeration equipment including condenser 50, condenser fan 52, and compressor 48 for example.

In still further accordance with the present invention, shelving is provided for supporting beverage containers inside the refrigerated compartment. As embodied herein and shown in FIG. 2 for example, a shelf 102 is supported above compartment bottom wall 20 by vertically extending support standards 104, 106 which are connected to shelf 102 at each opposite end thereof. Preferably, a plurality of similarly mounted shelves 102 are provided all along the lengths of support standards 104 and 106. However, only the uppermost shelf is illustrated in FIG. 2 in order to avoid unduly complicating the drawing and obscuring other features of the present invention. Each shelf 102 has a guardrail 108 that keeps beverage containers 110 from toppling over when situated on shelf 102. At least two of each standard 104, 106 are provided. Standards 104 are preferably of equal length to standards 106, and standards 104, 106 are mounted to compartment end walls 22, 24. The mounting of each standard 104 or 106 to an end wall 22 or 24 preferably is accomplished by a stud (not shown) extending from end wall 22 or 24 and engaging a keyhole shaped opening (not shown) defined in the side of the standard. The stud can be positioned selectively in any of a number of receiving openings provided at different heights at regular intervals in end walls 22 and 24 in order to permit the height of the standard above the bottom wall of compartment 12 to be varied. Alternatively, the stud can be permanently fixed into the end wall at a certain height, and each standard can have a number of key-holes arranged therein at different heights. Rear standards 104 preferably are disposed in the vicinity of rear compartment wall 14, while each forward standards 106 preferably are disposed near the compartment access opening opposite rear compartment wall 14. Moreover, rear standards 104 preferably are mounted higher on compartment end walls 22, 24 than forward standards 106. Thus, each shelf 102 typically is disposed with its rear end, which is attached to at least two spaced apart rear standards 104, elevated from its forward end, which is attached to at least a pair of spaced apart forward standards 106. This shelf arrangement permits more shelf space than if each shelf were to be horizontally disposed between the two sets of support standards. This additional shelf space permits additional products to be stored in the refrigerated compartment. Moreover, shelves 102 are thus slanted to automatically move the next stored container into the next-to-be-purchased orientation closest to the compartment access opening by virtue of gravity feed. However, the elevation of the rear portion of each shelf must be accommodated in the refrigerated compartment in order to permit adequate clearance for the product stored at the rear portion of each shelf, and particularly the uppermost shelf shown in FIG. 2 for example.

In still further accordance with the present invention, an evaporator is provided inside the refrigerated compartment. However, in order to facilitate accommodating the elevated rear portion of the shelving, the evaporator is disposed so that its smallest dimension is measured in a direction normal to the top wall of the compartment and parallel to the rear wall of the compartment. As embodied herein and shown in FIG. 2 for example, an evaporator 112 is disposed near top compartment wall 16 inside refrigerated compartment 12. Evaporator 112 is disposed closer to rear compartment wall 14 than to the compartment access opening, which is located opposite to rear compartment wall 14. FIG. 2 illustrates an end plan view of evaporator 112, which includes a height dimension 114 and a depth dimension 116. Height dimension 114 extends in a direction normal to compartment top wall 16 and parallel to compartment rear wall 14. Height dimension 114 is the smallest dimension of evaporator 112, and the width dimension of evaporator 112 is the largest dimension and cannot be seen in the view shown in FIG. 2. However, the width of evaporator 112 preferably extends between compartment end walls 22, 24 for substantially the full width of refrigerated compartment 12. Similarly, depth dimension 116 of evaporator 112 extends in a direction normal to compartment rear wall 14 and parallel to compartment top wall 16. A condensate drip pan 118 preferably is disposed beneath evaporator 112 to catch condensate dripping off evaporator 112. This dripping condensate is preferably transferred from drip pan 118 to condensate tray 53 located in housing 38.

In yet further accordance with the present invention, means are provided for circulating cool air in the refrigerated compartment so that the coolest air initially encounters the beverages which are stored closest to the selective access means and thus are the beverages next-to-be-purchased by the consumer. Cooled air from the evaporator preferably is forced from the top to the bottom of the compartment and from the front to the back of the compartment. The cooled air circulation means preferably includes a duct panel disposed near the top wall of the refrigerated compartment and a cold air blower. As shown in FIG. 2 for example, a duct panel 120 is disposed near top compartment wall 16 and extends between end walls 22, 24 of refrigerated compartment 12. Duct panel 120 defines a cooled air duct indicated generally in FIG. 2 by the designating numeral 122. Duct 122 is defined between duct panel 120 and portions of top compartment wall 16 and front compartment wall 18. Front wall 18 preferably is configured to turn the cooled air flow toward a duct exit (described hereafter). As shown in FIG. 2 for example, compartment front wall 18 preferably extends at an obtuse angle, preferably about 120°, from top compartment wall 16 and toward the front of the merchandiser so as to provide a turning boundary for cooled air flow, as described hereafter. However, front wall 18 can be provided preferably with a radius and so direct the cooled air stream along a smoothly curving path.

Duct 122 preferably defines a rear end indicated generally in FIG. 2 by the designating numeral 124. Rear end 124 of duct 122 preferably is open and faces toward rear compartment wall 14 and preferably immediately addresses the forwardmost portion of evaporator 112. Duct panel 120 further defines a forward exit flap 126 at one end thereof generally disposed closer to compartment wall 18 than compartment rear wall 14 and opposite the end which defines open rear end 124 of duct 122. Forward exit flap 126 of duct panel 120 defines a duct exit indicated generally in FIG. 2 by the designating numeral 128. Duct exit 128 preferably is configured to direct air exiting from duct 122 toward the compartment access opening and the selective access means, such as doors 26, 28, which can be positioned to close off the compartment access opening.

The cooled air circulation means further preferably includes a cold air blower 130 which is disposed for moving air cooled by evaporator 112 through duct exit 128, as indicated in FIG. 2 by the arrows designated 132. Thus, cold air blower 130 creates a circulation air path that draws relatively warmer air (see arrows designated 133 in FIG. 2) rising at the rear of compartment 12 through evaporator 112 from the rear portion of evaporator 112 to exit through the forward facing portion of evaporator 112. The cooled air exiting the forward portion of evaporator 112 is then directed and propelled by blower 130 through duct exit 128 in a direction that impinges against the upper portion of doors 26, 28, when such doors are closed across their respective compartment access openings. This coolest air entering refrigerated compartment 12 distributes down the front of compartment 12 nearest the selective access opening so as to form an even temperature distribution of cooled air for all of the beverage containers disposed closest to the compartment access opening where the consumer will select the next-to-be-purchased beverage container. This disposition of cooled air circulation ensures that the next-to-be-purchased container, such as container 110' shown in FIG. 2 for example, is cooled the fastest and maintained sufficiently cooled for the consumers' immediate use.

Heretofore, the refrigerated cabinets circulated the cooled air from top to bottom, but from back to front. In this circulation scheme, the lowermost panels of the doors to the refrigerated cabinet were subjected to the most extreme temperature differentials from the inside of the refrigerated cabinet to the atmosphere outside the beverage merchandiser. Accordingly, the location of the defogging means near the bottom of the refrigerated doors oriented the greatest flows of warmed air where the need for the warm air was greatest, i.e., near the greatest temperature differentials at the bottom of the doors to the cabinet. However, with the present invention's front to back circulation flow, in order to provide greater assurance of cooling the next-to-be-purchased product most quickly and uniformly, the greatest temperature differentials have shifted to the uppermost portions of the doors to the refrigerated compartment. Locating the refrigeration equipment at the top of the cabinet, while providing means for generating warmed air close to the site where the warmth would be most needed, has the drawback of making the refrigerated cabinet top heavy and difficult to service. Because the next-to-be-purchased refrigerated cabinet would be subjected to unattended consumer usage, the prospect of a top heavy cabinet would impose certain other structural requirements for safety's sake. In order to meet these requirements, it might be necessary to increase the bulk and weight of the overall cabinet and accordingly increase manufacturing costs of assembly and materials. On the other hand, leaving the refrigeration equipment in the housing beneath the refrigerated cabinet, located the source of the warmest air a substantial distance from where the warmest air was required to address the greatest temperature differentials, namely, near the uppermost portions of the doors to the compartment.

In still further accordance with the present invention, means are provided for transferring warmed air onto the selective access means to continuously defog the selective access means. The warm air transferring means of the present invention acts as the continuous defogging means for the selective access means. As embodied herein and shown in FIGS. 1 and 2 for example, the warm air transferring means preferably includes an elongated front grill 56 which preferably is mounted across the front opening of housing 38 in a conventional detachable manner such as by a bolt which mounts in a slotted hole arrangement. Front grill 56 preferably defines grill openings 58 through which air can be drawn into housing 38 from outside the merchandiser. As shown in FIGS. 1, 2, 4 (in phantom), and 5, front grill 56 preferably defines a channel 60 disposed in front of the front opening of housing 38. Channel 60 preferably extends substantially the full length of the extent of the selective access means such as doors 26, 28. Channel 60 preferably is disposed below the selective access means of the compartment and communicates with the housing to receive warmed air from the housing. As shown in FIGS. 2 and 5 for example, communication between housing 38 and channel 60 is provided by a channel opening 62 defined through the rear wall of channel 60. Channel 60 preferably defines a front edge member 64 extending along substantially the full length of the extent of the selective access means along the front of the merchandiser. Front edge member 64 defines a slot 66 through which air entering channel 60 through opening 62 can exit. Front edge member 64 preferably is configured and disposed to direct air exiting slot 66 to attach to the exterior surface of the selective access means such as front glass panels 30 of doors 26, 28 when each door is closed across its respective compartment access opening. Preferably, front edge member 64 is disposed parallel to the selective access means such as front panels 30 of doors 26, 28. Front edge member 64 preferably extends for a sufficient length to be able to direct the exiting air flow in a direction parallel to the closed selective access means.

As embodied herein and shown in FIGS. 2, 4, and 5, the warm air transferring means further preferably includes an auxiliary blower 68. Blower 68 preferably is disposed to one side of compressor 48 and condenser 50 and has an inlet 70 shown in FIGS. 2 and 5. Inlet 70 preferably is disposed to face toward compressor 48 and condenser 50 and preferably towards the space between compressor 48 and condenser 50 where the air leaving condenser 50 is likely to be warmest. As shown in FIG. 2 for example, blower 68 preferably has an outlet 72, which preferably is connected to one end of a conduit 74. The opposite end of conduit 74 preferably is connected to channel opening 62 and secured thereto in air tight fashion as by a flexible gasket 76. Conduit 74 preferably is formed as a flexible hose, but could be formed by a rigid material such as a rigid plastic or metal. However, the flexibility of conduit 74 permits easier assembly and imposes less manufacturing tolerance requirements, and this lowers manufacturing and assembly costs.

When blower 68 is activated, its inlet 70, which as noted above is preferably disposed to face toward the air space between compressor 48 and condenser 50, draws warmed air from the condenser into the blower. This air shown in FIGS. 2 and 5 by the arrows designated 78 is provided under pressure to channel 60 through channel opening 62 and evenly distributes over the full extent of the length of channel 60 because of the pressurized head provided by blower 68. The warm air exiting channel 60 is indicated by arrows designated 80 in FIGS. 1, 2 and 5 for example. This warm air attaches to front panels 30 of doors 26, 28 and rises therealong to warm this surface and prevent it from condensing vapor from the atmosphere outside the merchandiser. The capacity of blower 68 can vary depending on the number of doors to be defogged For each door 26 or 28 measuring about 30 inches wide and 52 inches tall, blower 68 preferably provides about 30 cubic feet of warmed air per minute to channel 60 and through exit slot 66. Of this 30 cubic feet per minute per door amount, it is estimated that approximately 15 cubic feet per minute reaches the uppermost extent of each front glass panel 30 of each door 26 or 28. Auxiliary blower 68 preferably is wired electrically to operate continuously to provide continuous defogging of glass panels 30 of doors 26, 28. However, a switch also preferably is provided to deactivate blower 68 whenever the operator of the merchandiser desires to forego its use, for whatever reason.

The merchandiser of the present invention preferably includes a cabinet indicated generally by the designating numeral 82 in FIGS. 1–5 for example. Cabinet 82 preferably defines the outer shell of the merchandiser and encloses both the housing and the refrigerated compartment. As shown in FIGS. 2 and 3 for example, insulation 46 separates cabinet 82 from compartment 12.

In an alternative preferred embodiment shown in FIG. 3 for example, the means for transferring warmed air onto the selective access means for defogging purposes preferably includes an enclosure that houses a lighting display. The enclosure is indicated generally in FIG. 3 by the designating numeral 84. Enclosure 84 preferably is defined between compartment 12 and cabinet 82. Lighting enclosure 84 also preferably is disposed above the selective access means such as doors 26, 28. Preferably, front wall 18 of compartment 12 extends at an obtuse angle from top compartment wall 16 to define one surface of lighting enclosure 84. A display sign 86 is removably attached and positioned at the front of enclosure 84 and carries some advertising message which can be illuminated, as will be explained shortly. A lamp fixture 88 is preferably disposed within enclosure 84 for receiving a lamp 90, preferably a fluorescent light, which generates heat when in use. Fixture 88 further preferably includes a ballast 92 at the back of fixture 88, and ballast 92 throws off significant amounts of heat when lamp 90 is lighted.

As shown in FIG. 3 for example, an elongated exit chute 94 is preferably disposed to provide an exit from enclosure 84 at a location close to the selective access means and preferably beneath display sign 86. Exit chute 94 preferably extends along the front of the merchandiser for substantially the full width of the compartment access opening across the front of the merchandiser. A front exit lip member 96 preferably also extends substantially the full length of the extent of the compartment access opening along the front of the merchandiser. Exit lip member 96 preferably extends from the free end of an intermediate lip member 95. These two members preferably combine to define the exit portion of exit chute 94 and are substantially coextensive with exit chute 94. Exit lip member 96 further is preferably configured and disposed to direct air exiting chute 94 so that this exiting air attaches to the exterior surface of the selective access means when such means is enclosing the compartment access opening. Lip member 96 preferably is disposed so as to be parallel to the exterior surface of front glass panels 30 of doors 26, 28. As shown in FIG. 3 for example, an auxiliary fan 98 is electrically powered to move air heated by lamp fixture 88 through chute 94 to be directed by lip member 96 onto glass panels 30 of doors 26, 28. Instead of being disposed as shown in FIG. 3, fan 98 can be disposed preferably to face tangentially (blade facing the viewer head on in the view shown in FIG. 3) with respect to sign 86 or chute 94. Air circulation openings (not shown) preferably are provided above display sign 86 to permit air from outside the merchandiser to be drawn into enclosure 84 by operation of auxiliary fan 98. The air drawn into enclosure 84 is warmed by operation of fixture 88, including ballast 92, and moves out of enclosure 84 through chute 94 disposed beneath display sign 86. This warmed air is indicated generally by the arrows designated 100 in FIG. 3 and attaches to the exterior surface of glass panels 30 of doors 26, 28 when such doors are closed in front of the compartment access opening.

In still further accordance with the present invention, means are provided for pivotally supporting the rear end of the duct panel. As embodied herein and shown in FIG. 2 for example, the means for pivotally supporting the rear end of duct panel 120 preferably includes a cylindrical mounting post 134, which preferably extends normally from each compartment end wall 22, 24. Each cylindrical mounting post 134 preferably extends for about one inch from one of compartment end walls 22, 24 and is formed of a smooth plastic material so that no additional bearing mechanism is required. The pivotally supporting means further preferably includes a hooked rear end 136 at the rear end of duct panel 120. Hooked rear end 136 is cylindrically configured to rotate about mounting post 134.

In still further accordance with the present invention, means are provided for detachably supporting the duct panel at a predetermined orientation relative to the selective compartment access means. As embodied herein and shown in FIG. 2 for example, the detachably supporting means preferably includes a twist lock 138 having butterfly wings for easy manual manipulation. Alternatively, a knurled head fastener can be used in place of each twist lock 138. Each of end walls 22, 24 preferably has a keyed flange (not shown) extending therefrom to engage a twist lock 138. Preferably one twist lock mechanism is disposed at each opposite edge of duct panel 120 and engages its own keyed flange. The detachably supporting means of the duct panel permits easy access to cold air blower 130 and evaporator 112 by maintenance personnel. As shown in phantom in FIG. 2 for example, disengagement of twist lock 138 at each lateral edge of duct panel 120 enables duct panel 120 to be swung downwardly as hooked rear ends 136 of duct panel 120 pivot about their respective mounting posts 134. Furthermore, as shown in FIG. 2 for example, a lighting fixture 140 is mounted to the underside of duct panel 120 to provide illumination inside refrigerated compartment 12. Preferably, light fixture 140 receives a fluorescent lamp that does not produce a significant amount of heat during its operation.

In yet further accordance with the present invention, the cabinet has a base supported above the floor by four legs connected directly to load bearing braces. As embodied herein and shown in FIGS. 2, 4 and 5 for example, cabinet 82 includes a base 142 which preferably defines gauge 18 (0.045 inches thick) metal sheet material At least four legs 144 support cabinet base 142 above the floor on which the merchandiser rests. As shown in FIG. 4 for example, each leg 144 has a central shaft in the form of a leg leveling bolt 146 extending vertically through base 142. One end of a load bearing brace 148 engages each central shaft 146 of each leg 144 by any conventional attachment means such as a rivet nut. The opposite end of each load bearing brace 148 extends diagonally, preferably at a 45° angle (though the precise angle depends somewhat on the dimensions of the merchandiser), from each central shaft 146 to carry compartment bottom wall 20 and the central load of compartment 12. Furthermore, at least one hanger 150 has a lower end carrying one side of housing 38 and an upper end carried by the end of braces 148 extending beneath housing top panel 40. Preferably, more than one hanger 150 is provided for each side of housing 38. In this way, the four braces 148 carry the entire center load (side panels 42 carry their respective side loads of the merchandiser) of the merchandiser and transfer this load to legs 144 directly to the floor on which the merchandiser rests.

The provision of this load bearing arrangement enables the use of a lighter gauge sheet material for cabinet base 142 than previously was used in other load bearing designs for such merchandisers. This has resulted in significant materials savings, reduced the weight of the merchandisers, simplified manufacturing assembly procedures, rendered certain manufacturing tolerances less critical and therefore less costly to meet, and improved the overall structural integrity of the merchandiser and therefore potentially extended the useful life of the merchandiser.

What is claimed is:

1. A refrigerated merchandiser for single serving beverage containers intended for immediate consumption, the merchandiser comprising:

(a) a refrigerated compartment for holding items to be cooled;

(b) means for allowing selective access to said compartment;

(c) a housing which is heat insulated from said compartment;

(d) a condenser mounted for selective disposition into and out of said housing;

(e) a compressor mounted for selective disposition into and out of said housing;

(f) a condenser fan for operating in conjunction with the operating cycle of said compressor;

(g) means for transferring warmed air onto said selective access means to continuously defog said selective access means;

(h) an evaporator disposed inside said compartment; and (i) means for circulating the cooled air leaving said evaporator so that the path of cool air circulation begins by moving toward said selective access means before said cooled air moves toward any other portion of said compartment.

2. An apparatus as in claim 1, wherein:

said means for transferring warmed air onto said selective access means to continuously defog said selective access means includes an elongated channel disposed below said selective access means of said compartment, said channel extending substantially the full length of the extent of said selective access means along the front of the merchandiser and communicating with said housing to receive warmed air from said housing, said channel having an exit slot defined by a front edge member having a free edge disposed parallel to said selective access means.

3. An apparatus as in claim 1, wherein:

said compressor and condenser being separated by an air space between each other; and said means for transferring warmed air onto said selective compartment access means includes an auxiliary blower disposed to one side of said condenser and said compressor and having an inlet disposed to face toward the air space between said condenser and compressor.

4. An apparatus as in claim 3, wherein:

said means for transferring warmed air onto said selective compartment access means includes a conduit having one end communicating with the outlet of said blower and an opposite end communicating with said channel, said conduit including a flexible portion.

5. An apparatus as in claim 1, further comprising:

(j) a cabinet for enclosing said compartment therewithin; and wherein said means for transferring warmed air onto said selective access means to continuously defog said selective access means includes:

(i) an enclosure for housing a lighting display, said enclosure being defined between said compartment and said cabinet and disposed above said selective access means;

(ii) a lamp fixture disposed in said enclosure for receiving a lamp which generates heat when in use;

(iii) an elongated exit chute disposed in said enclosure at a location close to said selective access means;

(iv) an auxiliary fan disposed so as to move air heated by a lamp in said light fixture through said exit chute of said enclosure when said fan is activated; and (v) a front exit lip member extending substantially the full length of the extent of said selective access means along the front of the merchandiser and being configured and disposed to direct air exiting said chute to attach to the exterior surface of said selective access means.

6. An apparatus as in claim 1, wherein:

said cooled air circulation means includes:

(i) a duct panel disposed near the top of said compartment and defining a duct having an open rear end facing away from said selective access means, said evaporator being disposed at said rear end of said duct, said duct panel having a forward free edge defining a duct exit and being configured to direct air exiting from said duct toward said selective access means; and (ii) a cold air blower disposed relative to said duct for moving air cooled by said evaporator through said duct exit.

7. An apparatus as in claim 6, further comprising:

means for pivotally supporting said rear end of said duct panel; and means for detachably supporting said duct panel at a predetermined orientation relative to said selective compartment access means.

8. An apparatus as in claim 1, wherein:

said means for allowing selective access to said compartment includes a compartment access opening and at least one door having a triple pane, glass panel.

9. An apparatus as in claim 8, wherein:

said means for allowing selective access to said compartment includes at least two rotatable rollers attached to the top edge of each said door, and at least one overhead track for slidably receiving said rollers attached to each said door, each said track being disposed above said compartment opening.

10. An apparatus as in claim 8, further comprising:

a front grill, said housing having a front opening, said grill covering said front opening of said housing; and wherein said means for transferring warmed air from said housing onto said selective access means to continuously defog said selective access means includes an elongated channel disposed in said front grill, said channel extending substantially the full length of the extent of said doors along the front of the merchandiser and communicating with said housing via a conduit to receive warmed air from said housing.

11. An apparatus as in claim 1, further comprising:

a cabinet for containing said compartment and said housing, said cabinet having a base and said housing having a top panel;

at least four legs for supporting said cabinet above the floor on which the merchandiser rests, each said leg having a central shaft extending through said base;

at least four load bearing braces, each said brace having one end extending from beneath said top panel of said housing and having an opposite end mounting at one of said central shafts of said legs.

12. An apparatus as in claim 11, further comprising:

at least one hanger for carrying said housing, each said hanger having one end carried by said one end of one of said load bearing braces.

13. An apparatus as in claim 1, further comprising:

shelving for supporting beverage containers; and wherein said compartment defining a rear wall, a top wall, a pair of end walls, a front wall, a bottom wall, and at least one compartment access opening, at least one said opening being defined at least in part near a free edge of said front wall, each said shelf extending from just in front of said rear compartment wall to just behind said access opening and having the end nearest said rear compartment wall disposed at a greater height from said bottom compartment wall than the end nearest said compartment access opening.

14. A refrigerated merchandiser for storing single serving beverage containers, the merchandiser comprising:

(a) a compartment for holding items to be cooled, said compartment defining a rear wall, a top wall, a pair of end walls, a front wall extending from said top compartment wall, a bottom wall, and at least one compartment access opening, each said opening being defined between said bottom wall and said front wall;

(b) at least one door for selectively opening and closing across said compartment access opening, each said door having a triple pane, glass panel and at least two rollers;

(c) at least two tracks for slidably receiving the rollers of each said door, said tracks being disposed above said compartment opening;

(d) a cabinet for enclosing said compartment therewithin;

(e) an enclosure for containing a lighting display, said enclosure being defined between said front compartment wall and said cabinet;

(f) a lamp fixture disposed in said enclosure for receiving a lamp generating heat when in use;

(g) an elongated exit chute disposed in said enclosure at a location closer to said compartment access opening than to said top compartment wall;

(h) an auxiliary fan disposed so as to move air heated by a lamp in said light fixture through said exit chute of said enclosure when said blower is activated;

(i) a front edge member extending substantially the full length of the extent of the doors along the front of the merchandiser and being configured and disposed to direct air exiting said chute to attach to the exterior surface of each said door when each said door extends across each said compartment opening;

(j) a compressor mounted outside said compartment;

(k) a condenser mounted outside said compartment;

(l) an evaporator disposed between said end walls of said compartment; and (m) means for circulating the cooled air leaving said evaporator toward each said compartment access opening before said air reaches said rear wall of said compartment.

15. An apparatus as in claim 14, further comprising:

shelving for supporting beverage containers, each said shelf extending from just in front of said rear compartment wall to just behind said access opening and having the end nearest said rear compartment wall disposed at a greater height from said bottom compartment wall than the end nearest said access opening.

16. An apparatus as in claim 14, wherein:

said means for circulating the air leaving said evaporator toward each said compartment access opening before said air reaches said rear wall of said compartment includes:

(i) a duct panel disposed near said top wall of said compartment and extending between said end walls of said compartment to define a duct having an open rear end facing toward said rear compartment wall, said duct panel having a forward exit flap, said duct panel forward exit flap defining a duct exit configured to direct air exiting from said duct toward said doors, said front compartment wall extending from said top compartment wall and configured to direct air flow toward said duct exit;

(ii) an evaporator disposed at said rear end of said duct and closer to said rear wall than to said front wall, said evaporator having a height, width and depth, said width being longer than said height, said width being longer than said depth, said height being disposed to extend in a direction normal to said top compartment wall and parallel to said rear compartment wall; and (iii) a cold air blower disposed for moving air cooled by said evaporator through said duct exit.

17. An apparatus as in claim 16, further comprising:

(n) means for pivotally supporting said rear end of said duct panel; and (o) means for detachably supporting said duct panel at a predetermined orientation relative to said front wall of said compartment.

18. An apparatus as in claim 14, wherein:

said evaporator is disposed near said top wall of said compartment and closer to said rear wall than to said front wall, said evaporator having a height, width and depth, said width being longer than said height, said width being longer than said depth, said depth being disposed to extend in a direction normal to said top compartment wall and normal to said rear compartment wall, and said width being disposed to extend between said compartment end walls.

19. A refrigerated merchandiser for single serving beverage containers, comprising:

(a) a compartment for holding items to be cooled, said compartment defining a rear wall, a top wall, a pair of end walls, a front wall, a bottom wall, and at least one compartment access opening, each said opening being defined at least in part near a free edge of said front wall;

(b) at least one door having at least one triple pane glass panel and at least two rollers attached to one edge of said door, said door for selectively providing and denying access to said compartment access opening;

(c) at least one track for slidably receiving said rollers of at least one said door, said tracks being disposed across and above said compartment opening;

(d) a housing defining a top panel, two opposed side panels, and a front opening;

(e) compressor mounted in said housing;

(f) a condenser mounted in said housing and disposed closer to said front opening of said housing than said compressor;

(g) a condenser fan for operating in conjunction with the operating cycle of said compressor, said condenser fan being disposed between said compressor and said condenser;

(h) an auxiliary blower disposed to one side of said compressor and condenser and having an inlet disposed to face toward said compressor and said condenser, said blower having an outlet;

(i) an elongated front grill having a channel disposed in front of said front opening of said housing, said channel extending substantially the full length of the extent of said glass panels along the front of the merchandiser and communicating with said housing to receive warmed air from said housing, said channel having an exit slot defined by a front edge member extending along substantially the full length of the extent of the glass panels along the front of the merchandiser and being configured and disposed to direct air exiting said slot to attach to the exterior surface of each said glass panel when each said door closes each said compartment opening;

(j) a duct panel disposed near said top wall of said compartment and extending between said end walls of said compartment to define a duct having an open rear end facing toward said rear compartment wall, said duct panel having a forward free edge defining a duct exit and configured to direct air exiting from said duct toward said doors, said front compartment wall extending at an obtuse angle from said top compartment wall to direct cooled air flow to said duct exit;

(k) an evaporator disposed at said rear end of said duct and closer to said rear wall than to said front wall, said evaporator having a height, width and depth, said width extending between said end walls of said compartment, said width being longer than said height, said width being longer than said depth, said height being disposed to extend in a direction normal to said top compartment wall and parallel to said rear compartment wall, said height being shorter than said depth;

(l) a cold air blower disposed relative to said duct for moving air cooled by said evaporator through said duct exit;

(m) shelving for supporting beverage containers, each said shelf extending from just in front of said rear compartment wall to just behind said access opening and having the end nearest said rear compartment wall disposed at a greater height from said bottom compartment wall than the end nearest said access opening;

(n) a cabinet encompassing said compartment and said housing therewithin, said cabinet having a base disposed beneath said housing;

(o) an enclosure for housing a lighting display, said enclosure being defined between said front compartment wall and said cabinet;

(p) a lamp fixture disposed in said enclosure for receiving a lamp generating heat when in use;

(q) at least four legs supporting said cabinet base above the floor on which the merchandiser rests, each said leg having a central shaft extending through said base;

(r) at least four load bearing braces, each said brace having one end extending from beneath said housing top panel and having an opposite end mounting at one of said central shafts of said legs; and (s) at least one hanger carrying said housing, each said hanger having one end carried by said one end of one of said load bearing braces.

20. An apparatus as in claim 19, further comprising:

a conduit communicating with said outlet of said auxiliary blower and with said channel and having a flexible portion.

* * * * *